US009914001B1

(12) United States Patent
Wang

(10) Patent No.: US 9,914,001 B1
(45) Date of Patent: Mar. 13, 2018

(54) FIRE EXTINGUISHER

(71) Applicant: Chih-Chen Wang, Tainan (TW)

(72) Inventor: Chih-Chen Wang, Tainan (TW)

( * ) Notice: Subject to any disclaimer, the term of this patent is extended or adjusted under 35 U.S.C. 154(b) by 0 days.

(21) Appl. No.: 15/263,009

(22) Filed: Sep. 12, 2016

(51) Int. Cl.
*A62C 13/70* (2006.01)
*A62C 13/00* (2006.01)

(52) U.S. Cl.
CPC ..... *A62C 13/70* (2013.01); *A62C 13/003* (2013.01)

(58) Field of Classification Search
CPC ..... A62C 13/66; A62C 13/68; A62C 13/70; A62C 13/72; A62C 13/74
USPC ..... 169/71, 85, 88
See application file for complete search history.

(56) References Cited

U.S. PATENT DOCUMENTS 2,208,490 A * 7/1940 Axtell ..... A62C 13/74 137/72
2,430,470 A * 11/1947 Keefe, Jr. ..... A62C 13/006 169/72
2,533,685 A * 12/1950 Nurkiewicz ..... A62C 13/74 141/19
2,557,120 A * 6/1951 Knoblock ..... A62C 13/70 141/19
2,620,038 A * 12/1952 Somers ..... A62C 13/006 169/74
2,680,546 A * 6/1954 Seaberg ..... F16L 29/007 137/321
3,149,677 A * 9/1964 Blair ..... A62C 13/70 169/75
3,251,420 A * 5/1966 Rodgers ..... A62C 13/006 169/77
3,255,824 A * 6/1966 Rodgers ..... A62C 13/006 169/51
3,618,669 A * 11/1971 Sachs ..... A62C 13/006 169/76
3,650,329 A * 3/1972 Sachs ..... A62C 13/003 169/85
4,650,004 A * 3/1987 Wendling ..... A62C 13/74 169/85
6,189,624 B1 * 2/2001 James ..... A62C 13/74 169/61
7,128,163 B1 * 10/2006 Rousseau ..... A62C 13/66 169/30
7,318,484 B2 * 1/2008 Rousseau ..... A62C 13/003 169/77
8,820,423 B2 * 9/2014 Rousseau ..... A62C 13/66 169/71
9,144,699 B1 * 9/2015 Wang ..... A62C 13/70
(Continued)

*Primary Examiner* — Viet Le

(57) ABSTRACT

A fire extinguisher includes a barrel having a chamber with an opening covered by an upper cover that includes a guide-out passage having a tubular portion with a guide-in groove and an inlet. A guide-out groove is defined above a sealing edge and extends to the outside. A gas inlet unit is mounted to the upper cover and is connected to a high pressure steel bottle. A high pressure gas in the high pressure steel bottle can flow through a gas inlet passage into the chamber. A guide-out unit includes a guiding tube unit connected to the tubular portion and a valve connected to the guiding tube unit. The valve is opened when subjected to a pressure from the high pressure steel bottle. A piston valve normally and sealingly abutting a sealing edge of the tubular portion can be moved to a position in sealing contact with the sealing edge.

2 Claims, 4 Drawing Sheets

(56) References Cited

U.S. PATENT DOCUMENTS

| | | | | |
|---|---|---|---|---|
| 2007/0102167 | A1* | 5/2007 | Rousseau | A62C 13/003 169/77 |
| 2012/0211246 | A1* | 8/2012 | Zlatintsis | A62C 13/66 169/85 |
| 2012/0312566 | A1* | 12/2012 | Henry | B05B 7/04 169/85 |
| 2013/0220651 | A1* | 8/2013 | Rachidi | A62C 13/66 169/85 |
| 2015/0060093 | A1* | 3/2015 | Bongiornio | A62C 13/72 169/85 |

* cited by examiner

FIRE EXTINGUISHER

BACKGROUND OF THE INVENTION

The present invention relates to a fire extinguisher and, more particularly, to a fire extinguisher with a more reliable structure preventing powder from overflowing out of the fire extinguisher.

A type of conventional fire extinguisher generally includes a pressurized barrel receiving fire extinguishing powder. A guiding tube is mounted in the barrel and is connected to an outlet of the barrel. A piston valve is mounted in the guiding tube and is connected to a spring. The piston valve can be actuated by a pressing rod mounted on top of the barrel. A safety pin is mounted to the pressing rod. In use, the safety pin is removed, and the pressing rod is moved downward to open the piston valve. The powder in the barrel can be rapidly discharged via the guiding tube and the outlet under action of the air pressure in the barrel.

To avoid adverse influence on movement of the piston valve resulting from accumulation of the powder in the position of the spring, the above fire extinguisher must be placed upright when not in use. However, when the fire extinguisher is placed in a car or an unfixed position, it is difficult to maintain the fire extinguisher in the upright position, and the pressing rod could be inadvertently actuated by shock.

Another type of fire extinguisher includes an external high pressure steel bottle fixed to the barrel. The barrel receives fire extinguishing powder, and a piston valve is mounted in an outlet of the barrel. A firing pin and a switch are mounted to the barrel in a position corresponding to the steel bottle. Before the high pressure steel bottle is opened, the barrel does not have high pressure because the piston valve blocks the passage where the outlet is located. However, when the fire extinguisher is not placed upright or the fire extinguisher is placed in a car and is subjected to shock, the piston valve is apt to displace and cause overflow of the powder.

BRIEF SUMMARY OF THE INVENTION

An objective of the present invention is to provide a fire extinguisher that can be placed in any angular position to prevent the powder from overflowing even though the fire extinguisher is subjected to shock, thereby providing a reliable fire extinguisher.

A fire extinguisher according to the present invention includes a barrel including a chamber having an upper end with an opening. The chamber is configured to receive fire extinguishing powder. An upper cover covers the opening of the barrel. The upper cover includes a gas inlet passage and a guide-out passage. The guide-out passage includes a tubular portion facing the chamber of the barrel. The tubular portion includes a guide-in groove in a central portion thereof and an inlet in a lower end thereof. The tubular portion further includes an inner periphery with a sealing edge. A guide-out groove is defined above the sealing edge and extends to an outer side of the upper cover. A gas inlet unit is mounted to the upper cover and is located corresponding to the gas inlet passage. The gas inlet unit is configured to be connected to a high pressure steel bottle. The gas inlet unit can be operated to make a high pressure gas in the high pressure steel bottle flow through the gas inlet passage into the chamber of the barrel. A guide-out unit includes a guiding tube unit, a valve, a piston unit, and a pressing rod. The guiding tube unit is connected to the tubular portion of the upper cover. The guiding tube unit includes a lower end having an inlet. The valve is connected to the guiding tube unit. The valve is closed when the valve is not subjected to a pressure. The valve is opened when the valve is subjected to a pressure from the high pressure steel bottle into the barrel. The piston unit includes a piston and a piton valve mounted to the piston. The piston valve is configured to sealingly abut the sealing edge of the tubular portion of the upper cover. The pressing rod is configured to move the piston to a position in which the piston valve is not in sealing contact with the sealing edge of the tubular portion.

In an example, the valve is a one-way valve including an annular receiving portion mounted around a periphery of a top portion of an inner tube of the guiding tube unit. The valve further includes a stop portion on a top end of the annular receiving portion. A protrusion protrudes upward from a central portion of the stop portion. The protrusion includes a cutout portion.

In an example, the guiding tube unit includes an outer tube and an inner tube. The outer tube is connected to the tubular portion of the upper cover and includes a lower end having an inlet. The inner tube is mounted inside the outer tube and extends beyond a top end of the outer tube.

In an example, the upper cover includes a through-hole extending upward from the guide-in groove to a top end of the upper cover. The piston unit further includes a block fixed to an inner periphery of the tubular portion of the upper cover. The block has a through-hole in a central portion thereof. The piston valve is located on a lower end of the piston. The piston further includes a piston rod on an upper end thereof. The piston rod extends through the through-hole of the block and includes a top end beyond the through-hole of the block. A spring is mounted between the block and the piston valve. The pressing rod is mounted on top of the upper cover in a position corresponding to the piston rod. The pressing rod is movable downward to move the piston to the position in which the piston valve is not in sealing contact with the sealing edge.

In an example, the gas inlet unit includes a switch, a firing pin, and a safety pin. The switch is inoperable when the safety pin is not removed. After the safety pin is removed, the switch is operable to activate the firing pin to open the high pressure steel bottle, such that the high pressure gas flows into the chamber of the barrel via the gas inlet passage.

The present invention will become clearer in light of the following detailed description of illustrative embodiments of this invention described in connection with the drawings.

DESCRIPTION OF THE DRAWINGS

FIG. 3A is an enlarged view of a circled portion of FIG. 3.

DETAILED DESCRIPTION OF THE INVENTION

Figures 1, 1A:
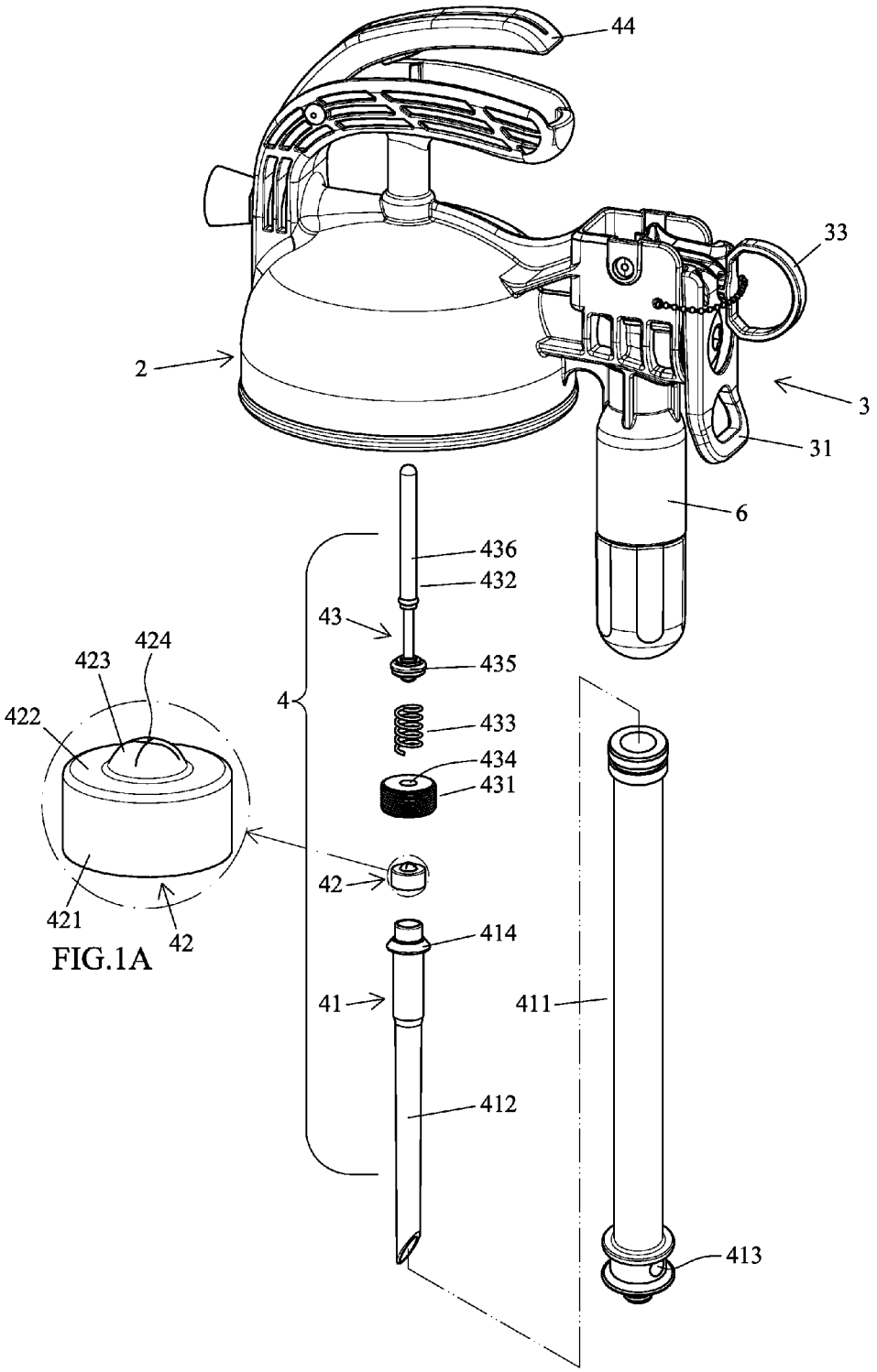
FIG. 1 is a partial, perspective view of a fire extinguisher according to the present invention.
FIG. 1A is an enlarged view of a circled portion of FIG. 1.
Figures 2, 2A:
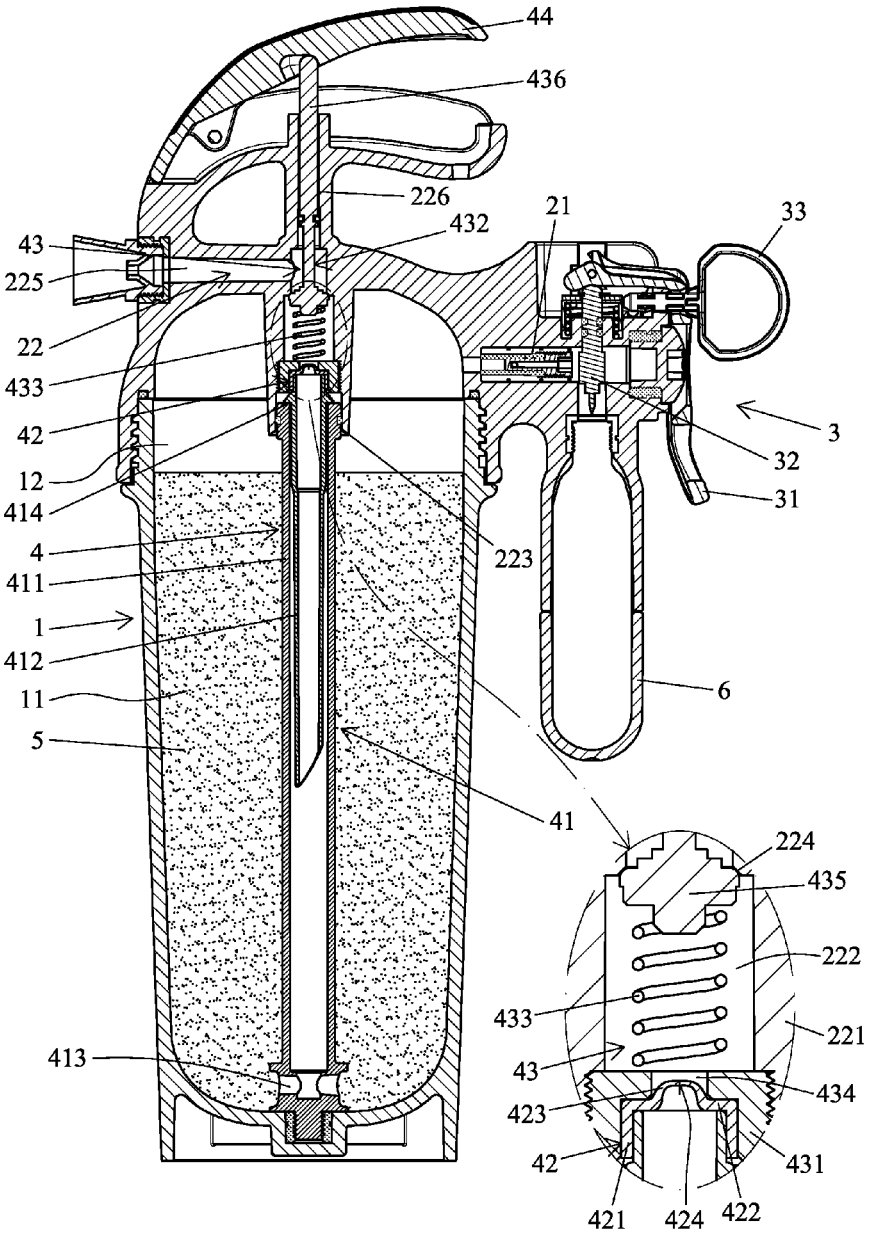
FIG. 2 is a cross sectional view of the fire extinguisher.
FIG. 2A is an enlarged view of a circled portion of FIG. 2.

With reference to FIGS. 1, 1A, 2, and 2A, a fire extinguisher according to the present invention includes a barrel 1, an upper cover 2, a gas inlet unit 3, and a guide-in unit 4. The barrel 1 includes a chamber 11 configured to receive fire extinguishing powder 5. The chamber 11 includes an upper end having an opening 12.

The upper cover 2 covers the opening 12 of the barrel 1 and includes a gas inlet passage 21 and a guide-out passage 22. The guide-out passage 22 includes a tubular portion 221 facing the chamber 11 of the barrel 1. The tubular portion 221 includes a guide-in groove 222 in a central portion thereof and an inlet 223 in a lower end thereof. The tubular portion 221 further includes a sealing edge 224 on an upper end of an inner periphery thereof. A guide-out groove 225 is defined above the sealing edge 224 and extends to an outer side of the upper cover 2. Furthermore, the upper cover 2 includes a through-hole 226 extending upward from the guide-in groove 222 to a top end of the upper cover 2, The gas inlet unit 3 is mounted to the upper cover 2 and is located corresponding to the gas inlet passage 21. The gas inlet unit 3 is configured to be connected to a high pressure steel bottle 6. The gas inlet unit 3 can be operated to make a high pressure gas in the high pressure steel bottle 6 flow through the gas inlet passage 21 into the chamber 11 of the barrel 1. In this embodiment, the gas inlet unit 3 includes a switch 31, a firing pin 32, and a safety pin 33. The switch 31 is inoperable when the safety pin 33 is not removed. After the safety pin 33 is removed, the switch 31 is operable to activate the firing pin 32 to open the high pressure steel bottle 6, such that the high pressure gas flows into the chamber 11 of the barrel 1 via the gas inlet passage 21.

The guide-out unit 4 includes a guiding tube unit 41, a valve 42, a piston unit 43, and a pressing rod 44. The guiding tube unit 41 includes an outer tube 411 and an inner tube 412. The outer tube 411 is connected to the tubular portion 221 of the upper cover 2 and includes a lower end having an inlet 413. The inner tube 412 is mounted inside the outer tube 411. A flange 414 is formed on an upper end of an outer periphery of the inner tube 412 and has an outer diameter larger than an inner diameter of the outer tube 411, such that the flange 414 of the inner tube 412 can abut against the top end of the outer tube 411. Furthermore, the top end of the inner tube 412 extend upward beyond the top end of the outer tube 411.

The valve 42 can be made of rubber or any other material. In this embodiment, the valve 42 is a one-way valve including an annular receiving portion 421 mounted around a periphery of the top end of the inner tube 412 of the guiding tube unit 41. The annular valve 42 further includes a stop portion 422 on a top end of the annular receiving portion 421. A protrusion 423 protrudes upward from a central portion of the stop portion 422 and includes a cutout portion 424. The cutout portion 424 of the valve 42 is normally closed. When the protrusion 423 is subjected to a pressure from below, the cutout portion 424 of the protrusion 423 expands to form an opening for guiding the fire extinguishing powder 5 to the outside.

The piston unit 43 includes a block 431, a piston 432, and a spring 433. The block 431 is fixed to an inner periphery of the tubular portion 221 of the upper cover 2. The block 431 has a through-hole 434 in a central portion thereof. The piston 432 includes a piston valve 435 on a lower end thereof and a piston rod 436 on an upper end thereof. The piston 432 is located corresponding to the tubular portion 221 and the through-hole 226 of the upper cover 2. The piston rod 436 extends through the through-hole 226 of the block 431 and includes a top end beyond the through-hole 226 of the block 431. The spring 433 is mounted between the block 431 and the piston valve 435. The piston valve 435 is normally in sealing contact with the sealing edge 224 of the tubular portion 221 of the upper cover 2 under the action of the elastic force of the spring 433. The pressing rod 44 is mounted on top of the upper cover 2 in a position corresponding to the piston rod 436. The pressing rod 44 can be moved downward to move the piston 432 to the position in which the piston valve 435 is not in sealing contact with the sealing edge 224.

Figure 3:
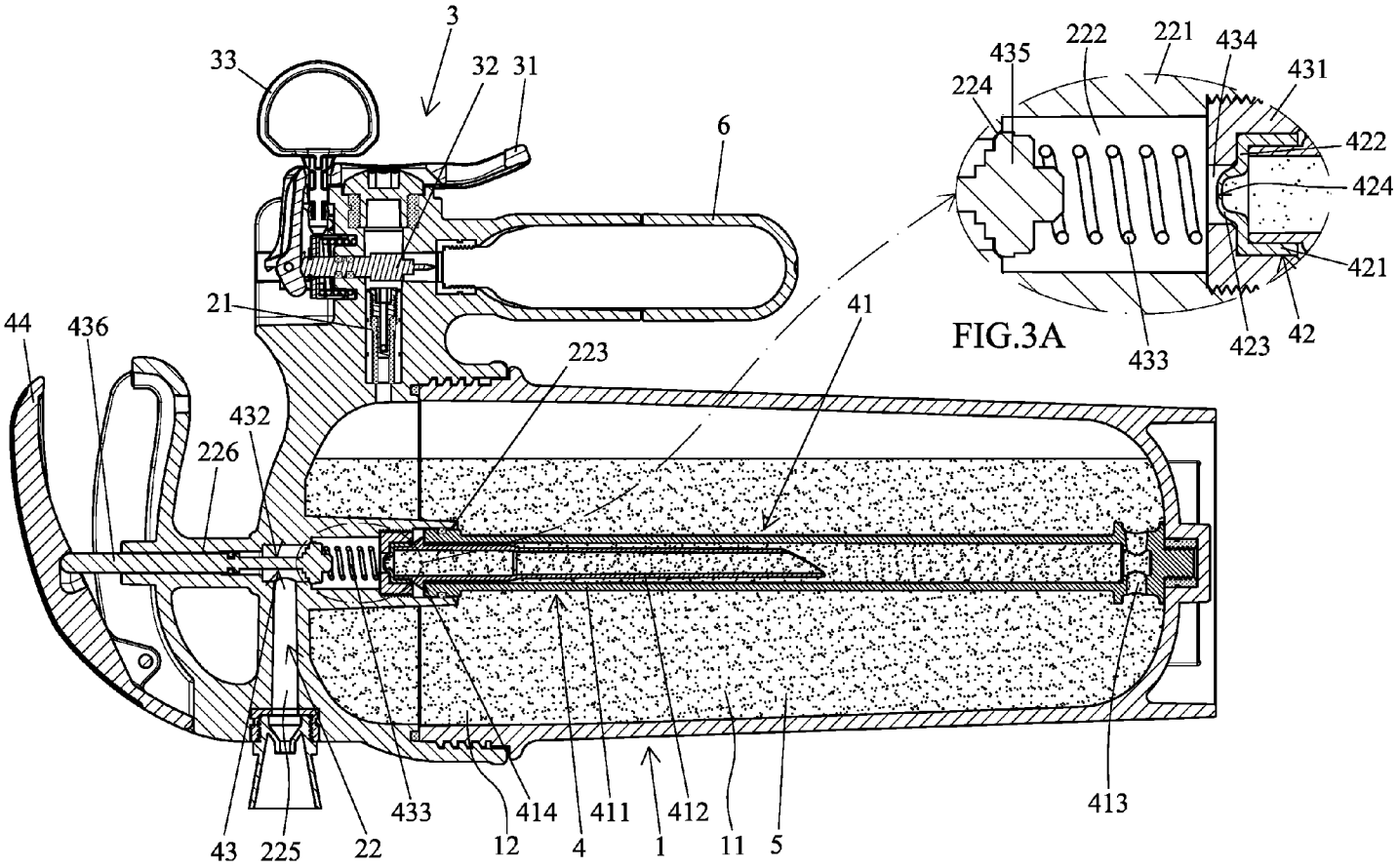
FIG. 3 is a cross sectional view of the fire extinguisher placed horizontally.
Figures 4, 4A:
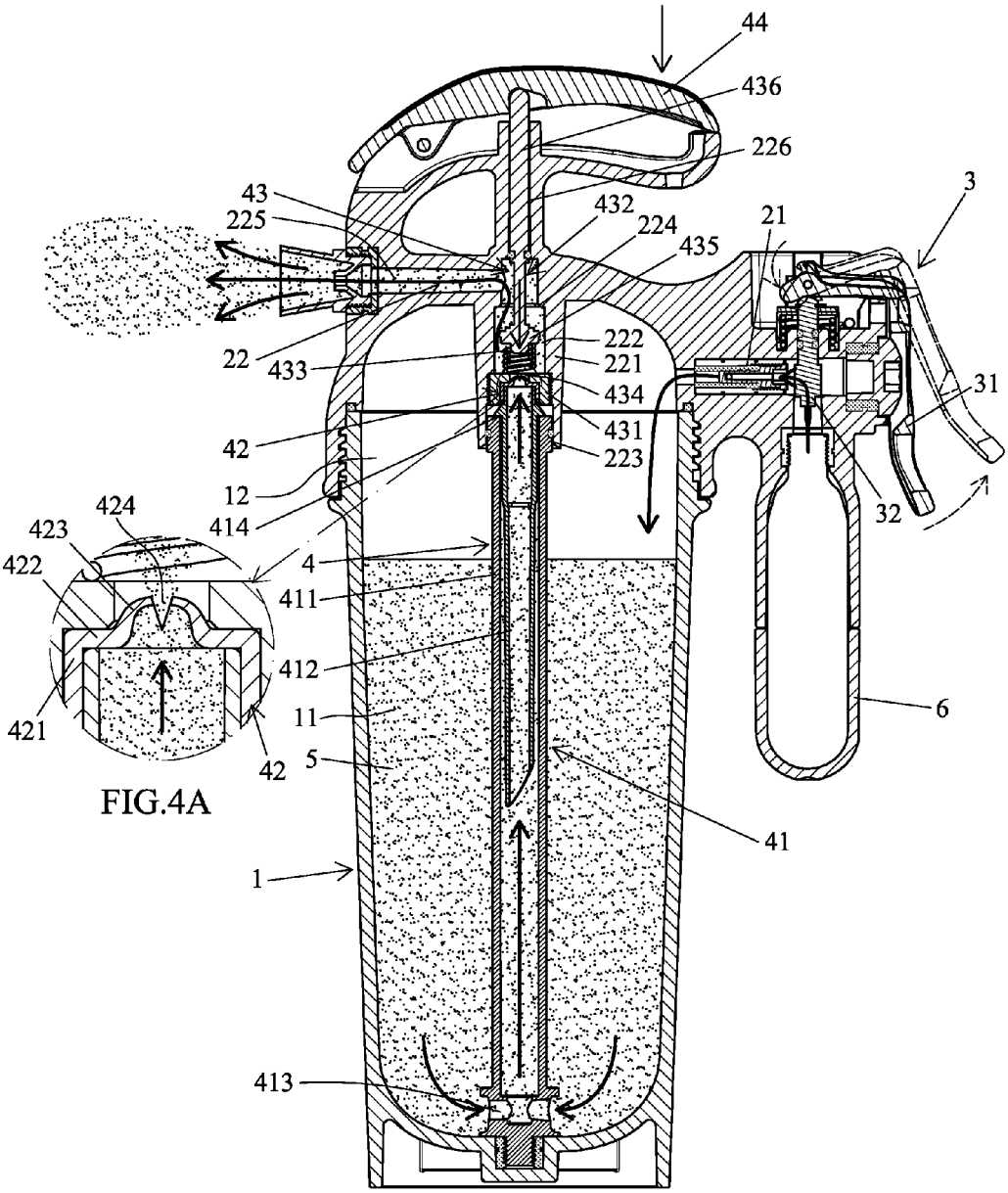
FIG. 4 is a cross sectional view of the fire extinguisher illustrating use of the fire extinguisher.
FIG. 4A is an enlarged view of a circled portion of FIG. 4.

The fire extinguisher can be placed in a car or any other position. With reference to FIGS. 3 and 3A, when the fire extinguisher is not in an upright position, the fire extinguishing powder 5 in the barrel 1 can enter the inner tube 412 of the guiding tube unit 41. However, the fire extinguishing powder 5 cannot reach the position where the spring 433 is located due to blockage by the valve 42 providing a first insulating mechanism. Furthermore, piston valve 435 and the sealing edge 224 of the tubular portion 221 provide a second insulating mechanism. Thus, the fire extinguishing powder 5 in the barrel 1 of the fire extinguisher would not overflow to the outside of the barrel 1 via the tubular portion 221 and the guide-out groove 225 even if the fire extinguisher rolls in a car. As a result, the fire extinguishing powder 5 is reliably retained in the barrel 1 when not in use.

With reference to FIGS. 2, 2A, 4, and 4A, when it is desired to put out a fire, the safety pin 33 is removed, and the switch 31 is operated to make the firing pin 32 open the high pressure steel bottle 6. The high pressure gas in the high pressure steel bottle 6 flows into the barrel 1 via the gas inlet passage 21, such that the pressure enters the barrel 1. Thus, the fire extinguishing powder 5 can enter a position above the valve 42 when the pressure makes the cutout portion 424 of the valve 42 expand. Furthermore, the pressing rod 44 can be pressed to actuate the piston 432, such that a gap exists between the piston valve 435 and the sealing edge 224 of the tubular portion 221. As a result, the fire extinguishing powder 5 can be guided to the outside via the guide-out groove 225 under the action of the high pressure.

In view of the foregoing, the fire extinguishing powder 5 will not overflow out of the fire extinguisher according to the present invention in any angle or any position, significantly increasing the reliability of the fire extinguisher while assuring the fire extinguisher has a sufficient amount of fire extinguishing powder to provide a reliable effect of putting out the fire.

Although specific embodiments have been illustrated and described, numerous modifications and variations are still possible without departing from the scope of the invention. The scope of the invention is limited by the accompanying claims.

The invention claimed is:

1. A fire extinguisher comprising:

a barrel including a chamber having an upper end with an opening, with the chamber configured to receive fire extinguishing powder;

an upper cover covering the opening of the barrel, with the upper cover including a gas inlet passage and a guide-out passage, with the guide-out passage including a tubular portion facing the chamber of the barrel, with the tubular portion including a guide-in groove in a central portion thereof and an inlet in a lower end thereof, with the tubular portion further including an inner periphery with a sealing edge, and with a guide-out groove defined above the sealing edge and extending to an outer side of the upper cover;

a gas inlet unit mounted to the upper cover and located corresponding to the gas inlet passage, with the gas inlet unit configured to be connected to a high pressure steel bottle, with the gas inlet unit operable to make a high pressure gas in the high pressure steel bottle flow through the gas inlet passage into the chamber of the barrel; and a guide-out unit including a guiding tube unit, a valve, a piston unit, and a pressing rod, with the guiding tube unit connected to the tubular portion of the upper cover, with the guiding tube unit including a lower end having an inlet, with the valve connected to the guiding tube unit, wherein the valve is closed when the valve is not subjected to a pressure, wherein the valve is opened when the valve is subjected to a pressure from the high pressure steel bottle into the barrel, with the piston unit including a piston and a piston valve mounted to the piston, with the piston valve configured to sealingly abut the sealing edge of the tubular portion of the upper cover, and with the pressing rod configured to move the piston to a position in which the piston valve is not in sealing contact with the sealing edge of the tubular portion, with the guiding tube unit including an inner tube, with the valve being a one-way valve including an annular receiving portion mounted around a periphery of a top portion of the inner tube of the guiding tube unit, with the valve further including a stop portion on a top end of the annular receiving portion, with a protrusion protruding upward from a central portion of the stop portion, and with the protrusion including a cutout portion.

2. The fire extinguisher as claimed in claim 1, with the upper cover including a through-hole extending upward from the guide-in groove to a top end of the upper cover, with the piston unit further including a block fixed to an inner periphery of the tubular portion of the upper cover, with the block having a through-hole in a central portion thereof, with the piston valve located on a lower end of the piston, with the piston further including a piston rod on an upper end thereof, with the piston rod extending through the through-hole of the block and including a top end beyond the through-hole of the block, with a spring mounted between the block and the piston valve, with the pressing rod mounted on top of the upper cover in a position corresponding to the piston rod, wherein the pressing rod is movable downward to move the piston to the position in which the piston valve is not in sealing contact with the sealing edge.

* * * * *